US011491807B2

(12) United States Patent
Fukuzawa et al.

(10) Patent No.: US 11,491,807 B2
(45) Date of Patent: Nov. 8, 2022

(54) PRINTING APPARATUS

(71) Applicant: SEIKO EPSON CORPORATION, Tokyo (JP)

(72) Inventors: Takanori Fukuzawa, Matsumoto (JP); Kenichi Kiryu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/209,736

(22) Filed: Mar. 23, 2021

(65) Prior Publication Data

US 2021/0300073 A1 Sep. 30, 2021

(30) Foreign Application Priority Data

Mar. 26, 2020 (JP) ..... 2020-056695

(51) Int. Cl.
*B41J 11/00* (2006.01)
*B41J 13/00* (2006.01)

(52) U.S. Cl.
CPC ..... *B41J 11/0095* (2013.01); *B41J 13/0009* (2013.01)

(58) Field of Classification Search
CPC ..... B41J 11/0095; B41J 15/04; B41J 29/38; B41J 11/42; B41J 13/0009; B41J 29/393
See application file for complete search history.

(56) References Cited

U.S. PATENT DOCUMENTS 8,240,593 B2 * 8/2012 Ito ..... B65H 16/021 242/598.3
9,227,809 B2 * 1/2016 Tanami ..... B41J 11/0095
2012/0051824 A1 3/2012 Omori
2013/0221054 A1 * 8/2013 Ogawa ..... B41J 29/48 226/181
2018/0257892 A1 * 9/2018 Eiyama ..... B41J 15/04

FOREIGN PATENT DOCUMENTS

JP 2012-45770 A 3/2012

* cited by examiner

*Primary Examiner* — Jannelle M Lebron
(74) *Attorney, Agent, or Firm* — Workman Nydegger

(57) ABSTRACT

A printing apparatus includes a rotary shaft configured to rotate while holding a roll body of a printing medium, a first motor configured to rotate the rotary shaft, a roller pair configured to transport the printing medium downstream by rotating in a state of pinching the printing medium, a second motor configured to rotate the roller pair, a first sensor configured to detect a tip end or a feature of the printing medium, a second sensor configured to detect the tip end or feature of the printing medium, and an outer diameter calculating unit configured to calculate an outer diameter of the roll body based on detection by the first sensor and detection by the second sensor, wherein the outer diameter calculating unit calculates an outer diameter of the roll body before the tip end of the printing medium is pinched by the roller pair.

4 Claims, 7 Drawing Sheets

PRINTING APPARATUS

The present application is based on, and claims priority from JP Application Serial Number 2020-056695, filed Mar. 26, 2020, the disclosure of which is hereby incorporated by reference herein in its entirety.

BACKGROUND

1. Technical Field

The disclosure relates to a printing apparatus.

2. Related Art

In a recording device capable of installing a plurality of roll papers, a recording device is disclosed that acquires, even during recording or transporting on one roll paper, information of a new roll paper when the new roll paper is installed (refer to JP-A-2012-45770).

According to JP-A-2012-45770, a transport roller located downstream of the roll paper and a sensor located downstream of the transport roller are arranged in an individual transport path of the roll paper. Then, the roll paper is transported using the transport roller after the roll paper is pinched between the transport roller and a pinch roller with a tip end of the roll paper being detected by a sensor. A diameter, i.e. an outer diameter, of the roll paper is calculated based on the transport amount and the amount of rotation of the roll paper at the above transportation.

The roller is located downstream of the roll paper and transports the fed rolled paper, where a rotational speed of the roller is constant. Therefore, from the roll paper to the roller, it is necessary to feed the roll paper at a transport speed that matches the rotational speed of the roller. For this purpose, the smaller the outer diameter of the roll paper, the higher speed of the rotation of the roll paper is needed.

In other words, in order to appropriately control the transportation of the roll paper, it is necessary to acquire the outer diameter of the roll paper as information.

However, in JP-A-2012-45770, when the roll paper is not pinched between the transport roller and the pinch roller, the outer diameter of the roll paper cannot be calculated. As a result, the outer diameter of the roll paper was unclear during the period when the roll paper had not yet reached the roller pair for the transportation.

SUMMARY

A printing apparatus includes a rotary shaft configured to rotate while holding a roll body obtained by winding a printing medium in a roll shape, a first motor configured to rotate the rotary shaft, a roller pair configured to transport the printing medium downstream in a transport path by rotating in a state of pinching the printing medium fed from the roll body to the transport path by rotation of the rotary shaft, a second motor configured to rotate the roller pair, a first sensor arranged at a position upstream of the roller pair in the transport path to detect a tip end of the printing medium or a feature formed at the printing medium, a second sensor arranged at a position upstream of the roller pair and downstream of the first sensor in the transport path to detect the tip end or feature of the printing medium, and an outer diameter calculating unit configured to calculate an outer diameter of the roll body based on detection by the first sensor and detection by the second sensor, wherein the outer diameter calculating unit calculates an outer diameter of the roll body before the tip end of the printing medium is pinched by the roller pair.

DESCRIPTION OF EXEMPLARY EMBODIMENTS

Hereinafter, exemplary embodiments of the present disclosure will be described below with reference to the accompanying drawings. Note that each of the drawings is merely illustrative for describing the present embodiment. Since the drawings are exemplary, the proportions and shapes may not be precise, match each other, or some may be omitted.

1. Apparatus Configuration

Figure 1:
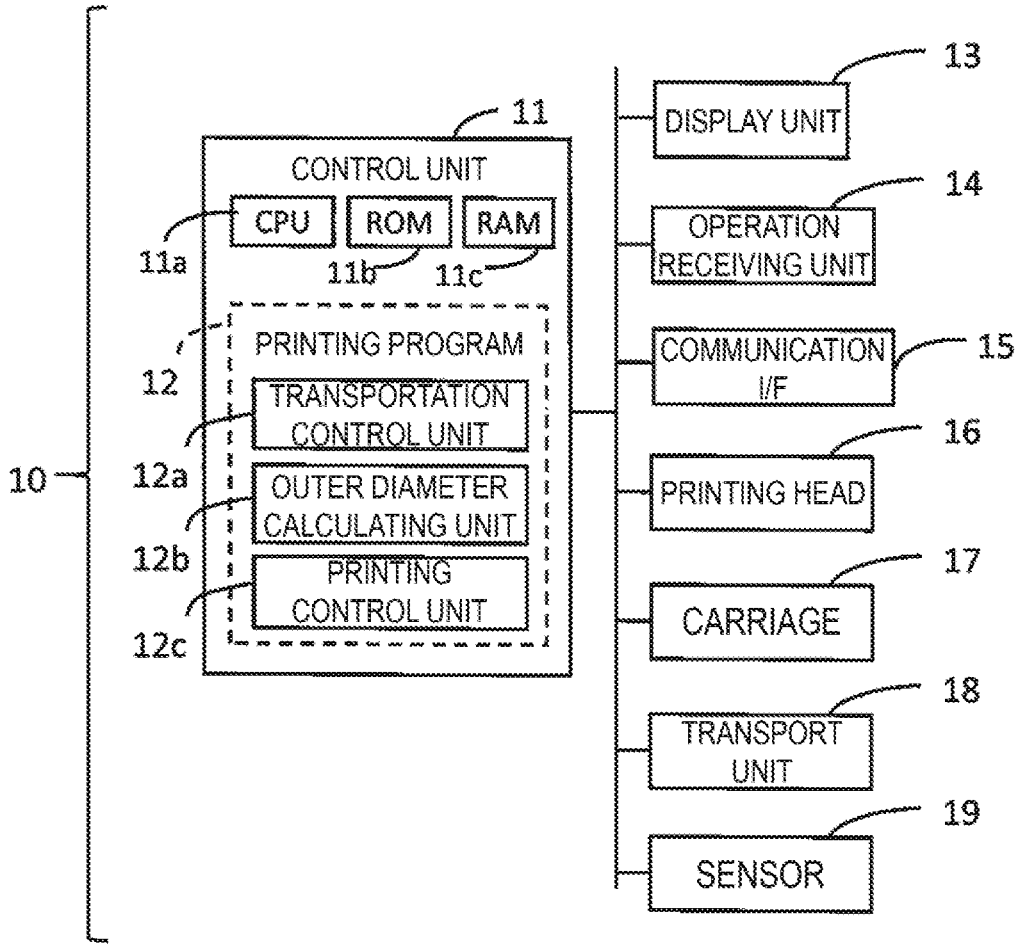
FIG. 1 is a block diagram simply illustrating an apparatus configuration.

FIG. 1 simply illustrates a configuration of a printing apparatus 10 according to the present embodiment.

The printing apparatus 10 includes a control unit 11, a display unit 13, an operation receiving unit 14, a communication I/F 15, a printing head 16, a carriage 17, a transport unit 18, a sensor 19, etc. I/F is an abbreviation for interface. The control unit 11 is configured to include one or more ICs having CPU 11*a* as a processor, ROM 11*b*, RAM 11*c*, etc., as well as other non-volatile memory, etc.

In the control unit 11, the processor, i.e., CPU 11*a*, performs arithmetic processing in accordance with a printing program 12 stored in ROM 11*b* or other memory, using RAM 11*c*, etc. as a work area, whereby implementing various functions such as a transport control unit 12*a*, an outer diameter calculating unit 12*b*, and a printing control unit 12*c*. Note that the processor is not limited to a single CPU, and may be a configuration in which processing is performed by a hardware circuit such as a plurality of CPUs, an ASIC, etc., or a configuration in which the CPU and the hardware circuit cooperate to perform the processing.

The display unit 13 is a means for displaying visual information, and is configured, for example, by a liquid crystal display, an organic EL display, etc. The display unit 13 may be configured to include a display and a driving circuit for driving the display. The operation receiving unit 14 is a means for receiving an operation by a user, and is realized, for example, by a physical button, a touch panel, a keyboard, etc. Needless to exemplify, the touch panel may be realized as a function of the display unit 13.

The display unit 13 and the operation receiving unit 14 may be portions of the configuration of the printing apparatus 10, while may be peripheral devices external to the printing apparatus 10. The communication I/F 15 is a generic term for one or more of the I/Fs that allow the printing apparatus 10 to connect to the outside in a wired or wireless manner according to a prescribed communication protocol including a known communication standard.

Figure 2:
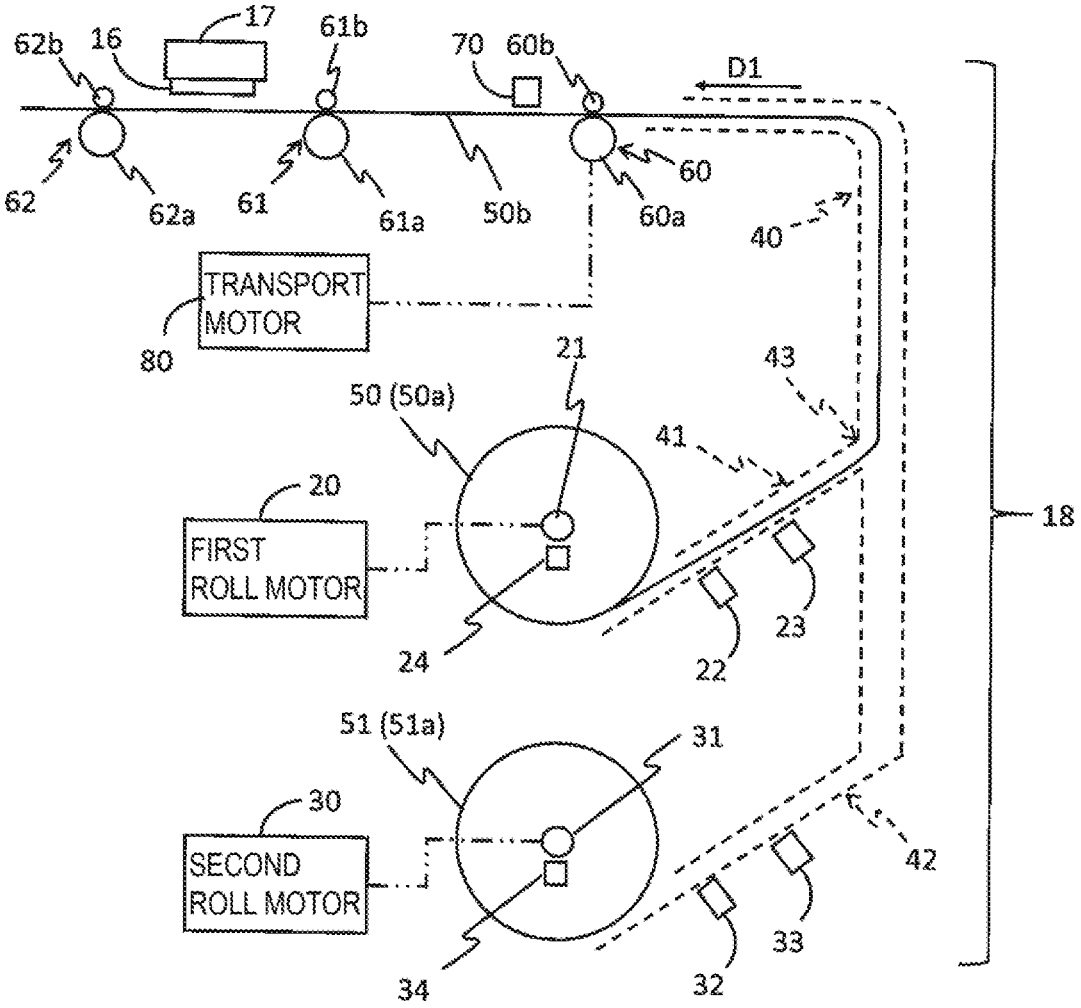
FIG. 2 is a diagram illustrating a specific example of a structure including a transport unit and a printing head.

The transport unit 18 is a means for transporting the printing medium, and includes each roller and each motor as illustrated in FIG. 2 described below. The printing head 16 performs printing on the printing medium using a color material such as ink or toner. The printing medium is typically a sheet. The printing medium may be any medium made of materials other than paper, as long as it can be printed by the color material. The printing head 16 discharges ink onto the printing medium by, for example, an ink jet method to perform printing. The carriage 17 is a mechanism capable of reciprocating along a predetermined primary scanning direction under power by a carriage motor (not illustrated). The carriage 17 mounts the printing head 16 and moves with the printing head 16, as illustrated in FIG. 2. The sensor 19 in FIG. 1 is described as a general term for various sensors included in the printing apparatus 10.

The transport control unit 12*a* controls the transport unit 18 to transport the printing medium to the transport unit 18. The printing control unit 12*c* controls the carriage 17 and the printing head 16 to perform printing on the printing medium.

The configuration of the printing apparatus 10 illustrated in FIG. 1 may be realized by a single printer, or may be realized by a plurality of apparatuses coupled in a communicable manner.

In other words, the printing apparatus 10 may be a printing system 10 as a matter of reality. The printing system 10 includes, for example, an information processing device that functions as the control unit 11, and a printer including the printing head 16, the carriage 17, the transport unit 18, and the sensor 19.

FIG. 2 simply illustrates a specific example of a structure including the transport unit 18 and the printing head 16.

The transport unit 18 has a first rotary shaft 21, which is a rotary shaft for holding a roll body of the printing medium. The first rotary shaft 21 rotates under power of a first roll motor 20. In the present embodiment, the form in which a long printing medium is wound in a roll shape is referred to as a "roll body", and the portion of the printing medium fed from the roll body is referred to as a "sheet". In the example illustrated in FIG. 2, a first roll body 50*a*, which is a roll body of a printing medium 50, is installed on the first rotary shaft 21. The first sheet 50*b* is fed from the first roll body 50*a*.

The transport unit 18 has a second rotary shaft 31, which is a rotary shaft for holding a roll body. The second rotary shaft 31 rotates under power of a second roll motor 30. In the example illustrated in FIG. 2, a second roll body 51*a*, which is a roll body of a printing medium 51, is installed on the second rotary shaft 31. In other words, the user can install the first roll body 50*a* to the first rotary shaft 21 and the second roll body 51*a* to the second rotary shaft 31. The first roll motor 20 corresponds to a "first motor" that rotates the first rotary shaft 21. The second roll motor 30 corresponds to a "third motor" that rotates the second rotary shaft 31.

The transport unit 18 has a transport path 40 that is a path through which the printing medium passes. In FIG. 2, a portion of the transport path 40 is easily indicated by broken lines in order to distinguish from the printing mediums 50, 51. The transport path 40 includes a first transport path 41 that is a transport path from the first rotary shaft 21, and a second transport path 42 that is a transport path from the second rotary shaft 31. The first transport path 41 and the second transport path 42 are merged. The merging point where the first transport path 41 and the second transport path 42 are merged is referred to as a merging point 43. The transport path 40 is a common path downstream from the merging point 43. Upstream and downstream of the transportation are also referred to simply as upstream and downstream.

In the transport path 40, a first roller pair 60, a second roller pair 61, and a third roller pair 62 are disposed downstream of the merging point 43. The roller pairs 60, 61, 62 transport the sheet downstream by rotating the sheet fed from the roll body to the transport path 40 in a pinched state. In the example illustrated in FIG. 2, the roller pairs 60, 61, 62 pinch the first sheet 50*b*, and transport the first sheet 50*b* in a transport direction D1.

The first roller pair 60, which lies most upstream in the roller pairs 60, 61, 62, is configured by a first driving roller 60*a* and a first driven roller 60*b*. The first driving roller 60*a* rotates under power by a transport motor 80. A driven roller rotates in response to the movement of the sheet by rotation of a driving roller in a paired relationship therewith.

The second roller pair 61 is disposed downstream of the first roller pair 60 and upstream of the printing head 16. The second roller pair 61 is configured by a second driving roller 61*a* and a second driven roller 61*b*. The third roller pair 62 is disposed downstream of the printing head 16. The third roller pair 62 is constituted by a third driving roller 62*a* and a third driven roller 62*b*. Although omitted from the illustration, the second driving roller 61*a* and the third driving roller 62*a* rotate under power by the transport motor 80 or a transport motor different from the transport motor 80. The transport motor 80 corresponds to a "second motor" that causes the roller pair to rotate.

Ink is discharged from the printing head 16 onto the sheet transported by the first roller pair 60 and the second roller pair 61. The printing head 16 has a plurality of nozzles capable of discharging ink. From the nozzles, the printing head 16 can discharge a plurality of colors of ink, such as cyan, magenta, yellow, black, etc. The printing head 16 prints an image represented by print data on the sheet by discharging or not discharging ink of each color from each nozzle based on the print data provided by the printing control unit 12*c*. After printing, the sheet is further transported downstream by the third roller pair 62, which leads to being wound and collected, or ejected to the outside of the printer. Even in the absence of the third roller pair 62, the sheet after printing can be transported downstream by the first roller pair 60 and the second roller pair 61.

The printing head 16 is mounted on the carriage 17. In FIG. 2, the primary scanning direction in which the carriage 17 moves is a direction perpendicular to the drawing. In other words, the printing head 16 prints the image across the width of the sheet by discharging the ink during movement of the carriage 17. The operation of discharging the ink by the printing head 16 along with movement of the carriage 17 is referred to as a scanning or a pass. The transport control unit 12*a* and the print control unit 12*c* enable printing on the sheet by performing alternation between the transportation of the sheet for a constant distance, called paper feeding, and the pass. The paper feeding is started after a tip end of the sheet is pinched by the second roller pair 61.

A sensor 22 and a sensor 23 are arranged along the first transport path 41 in the first transport path 41 upstream of the merging point 43. These sensors 22, 23 are referred to as a first upstream sensor 22 and a first downstream sensor 23, respectively, due to their mutual positional relationship. The first upstream sensor 22 corresponds to a "first sensor" and the first downstream sensor 23 corresponds to a "second sensor".

A sensor 32 and a sensor 33 are arranged along the second transport path 42 in the second transport path 42 upstream of the merging point 43. These sensors 32, 33 are referred to as a second upstream sensor 32 and a second downstream sensor 33, respectively, due to their mutual positional relationship.

The sensors 22, 23, 32, 33 are capable of detecting the tip end of the sheet or a feature formed at the sheet. An optical sensor, a mechanical sensor, or any other detection method may be used as the sensor. The feature of the sheet is, for example, a specific color patch, a specific mark, a specific character, or a hole of a specific shape. In the following, the sensors 22, 23, 32, 33 are described as sensors detecting the tip end of the sheet, however, the detection of the tip end of the sheet may be interpreted instead of detecting the feature of the sheet.

A PE sensor 70 is arranged slightly downstream of the first roller pair 60. The PE sensor 70 detects the tip end of the sheet. PE is an abbreviation for paper edges. The PE sensor 70 may also be a sensor that detects the feature of the sheet, but hereinafter the PE sensor 70 is described as a sensor detecting the tip end of the sheet, similar to the sensors 22, 23, 32, 33. The control unit 11 recognizes that the first roller pair 60 pinches the sheet by the PE sensor 70 detecting the tip end of the sheet. The sensors 22, 23, 32, 33, 70 are specific examples of the sensor 19, respectively. The control unit 11 inputs detection results from each of the sensors 22, 23, 32, 33, 70.

Furthermore, in the present embodiment, provided are a first encoder 24 that measures the amount of rotation of the first rotary shaft 21, and a second encoder 34 that measures the amount of rotation of the second rotary shaft 31. The first encoder 24 outputs a pulse signal for each rotation of the first rotary shaft 21 at a predetermined angle. Similarly, the second encoder 34 outputs a pulse signal for each rotation of the second rotary shaft 31 at a predetermined angle. The control unit 11 also inputs the output of each of the encoders 24, 34.

When a unit for holding one roll body and transporting the sheet from the roll body is referred to as a "transporting unit", the transport unit 18 includes, in the example of FIG. 2, a first transporting unit for the first roll body 50*a* and a second transporting unit for the second roll body 51*a*. That is, the first transporting unit includes the first roll motor 20, the first rotary shaft 21, the first upstream sensor 22, the first downstream sensor 23, the first encoder 24, and the first transport path 41. The second transporting unit includes the second roll motor 30, the second rotary shaft 31, the second upstream sensor 32, the second downstream sensor 33, the second encoder 34, and the second transport path 42. Such a configuration with two transporting units is not required in all of the present embodiments. The present embodiment also includes a configuration having only one transporting unit. Alternatively, the transport unit 18 may be configured to include three or more transporting units.

2. Description of Outer Diameter Calculation

Hereinafter, the outer diameter calculation process of the roll body will be described.

Figure 3:
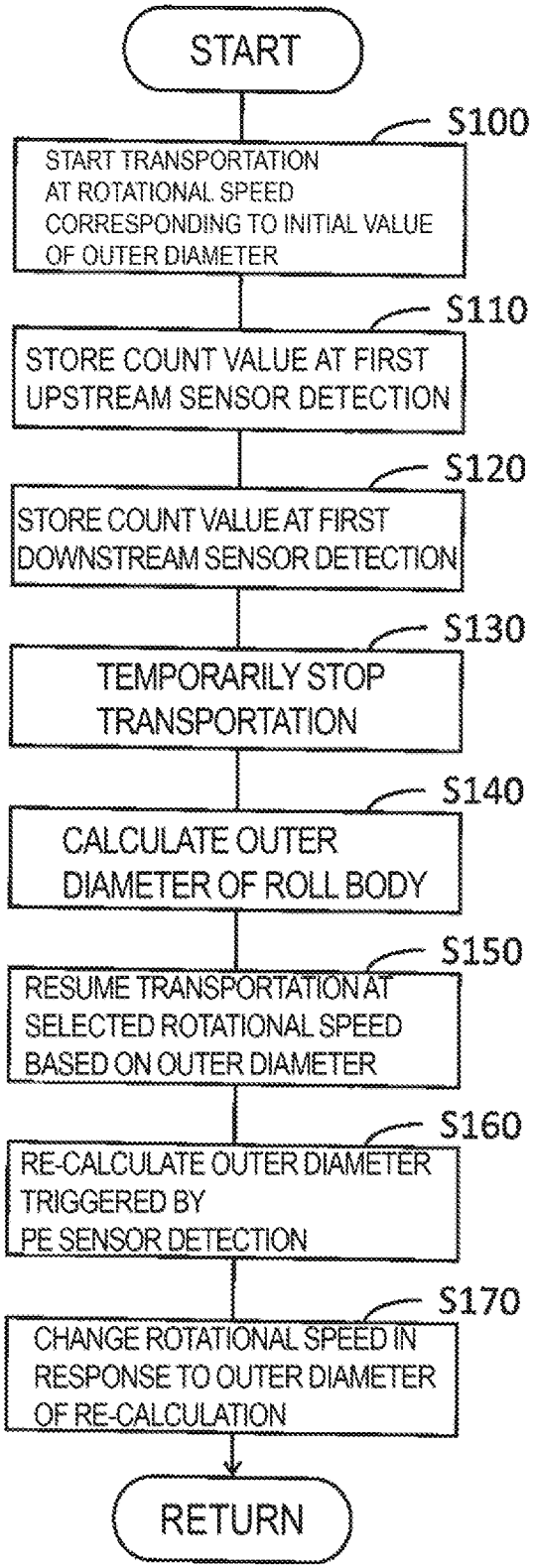
FIG. 3 is a flowchart illustrating a transport control process of a print medium.

FIG. 3 illustrates, in a flowchart, a transport control process of the printing medium performed by the control unit 11 in accordance with the printing program 12. the transport control process includes the outer diameter calculation process. FIG. 3 is an example of a situation in which the first roll body 50*a* installed on the first rotary shaft 21 is rotated to feed the first sheet 50*b* to the transport path 40. At the time of initiation of the transport control process, the tip end of the first sheet 50*b* is located upstream of the first upstream sensor 22. In the present example, it is assumed that the second roll body 51*a* does not affect the transport control process. In other words, it is assumed that the second transporting unit is not present, the second roll body 51*a* is not present even when the second transporting unit is present, or the sheet is not transported from the second roll body 51*a* downstream of the merging point 43 even when the second roll body 51*a* is present.

The control unit 11 that has received an instruction to start printing starts step S100 with the operation of the operation receiving unit 14 by the user, or with the notification from the outside received via the communication I/F 15.

In step S100, the transport control unit 12*a* controls the first roll motor 20 to rotate the first rotary shaft 21 at a rotational speed corresponding to an initial value of the outer diameter of the roll body, and then starts transporting the first sheet 50*b*. In other words, at the time of step S100, the outer diameter of the first roll body 50*a* is unknown. Therefore, the outer diameter of the first roll body 50*a* is assumed to be a predetermined initial value, such that the first 21 rotary shaft is rotated at a rotational speed corresponding to the initial value.

Figure 4:
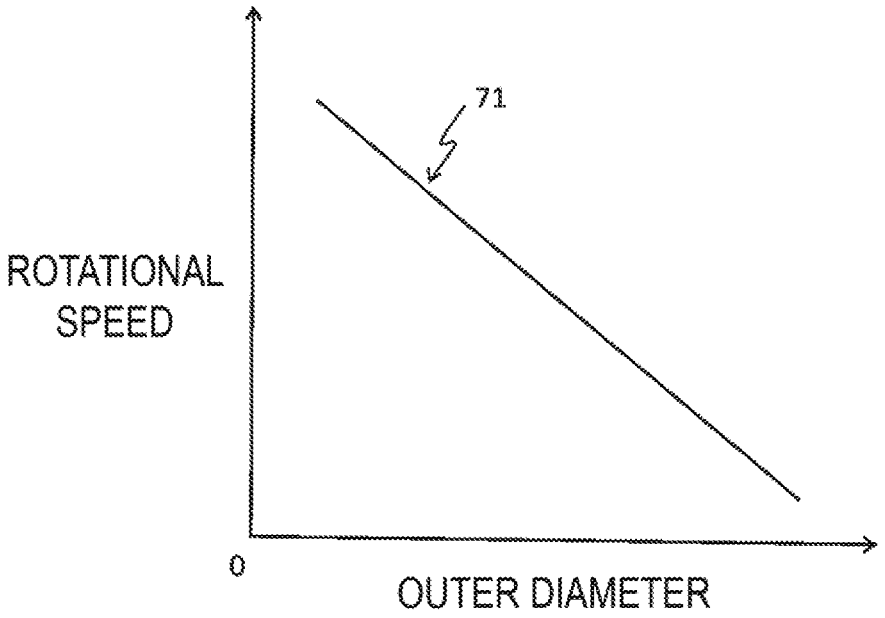
FIG. 4 is a diagram illustrating a rotational speed table.

In the present embodiment, as illustrated in FIG. 4 described below, the correspondence relationship between the outer diameter of the roll body and the rotational speed of the rotary shaft holding the roll body is predetermined.

Although not illustrated in FIG. 2, in the vicinity of the roll body installed on the rotary shaft, a release roller or other configuration for releasing the sheet from the roll body rotating along with the rotary shaft and steering the sheet smoothly to the transport path are appropriately disposed.

After the first sheet 50*b* is started to be transported by step S100, the outer diameter calculating unit 12*b* stores a count value by the first encoder 24 when the tip end of the first sheet 50*b* is detected by the first upstream sensor 22 (step S110). In other words, the outer diameter calculating unit 12*b* performs step S110 triggered by the first upstream sensor 22 detecting the tip end of the first sheet 50*b*.

The count value by the first encoder 24 is the amount of rotation of the first rotary shaft 21. Specifically, in step S110, a count number of the pulse signal output by the first encoder 24 is stored as the count value in a period from the time when the transportation is started in step S100 to the time when the first upstream sensor 22 detects the tip end of the first sheet 50*b*.

Furthermore, the outer diameter calculating unit 12*b* stores the count value from the first encoder 24 when the tip end of the first sheet 50*b* is detected by the first downstream sensor 23 (step S120). In other words, in step S120, the count number of the pulse signal output by the first encoder 24 is stored as the count value in a period from the time when the transportation is started in step S100 to the time when the first downstream sensor 23 detects the tip end of the first sheet 50*b*.

In step S130, the transport control unit 12*a* controls the first roll motor 20 to temporarily stop the rotation of the first rotary shaft 21. Steps S120 and S130 are performed substantially at the same time. As a result, immediately after the tip end of the first sheet 50*b* passes through the position of the first downstream sensor 23, the transportation of the first sheet 50*b* is temporarily stopped.

In step S140, the outer diameter calculating unit 12*b* calculates the outer diameter D of the first roll body 50*a* according to the following equation (1).

$$D=L/(n\times(C2-C1)/Cr) \quad (1)$$

L is a distance between the first upstream sensor 22 and the first downstream sensor 23 in the first transport path 41, which is a known value regarding the structure of the printing apparatus 10. n is the circumferential ratio.

C2 is the count value stored in step S120 and C1 is the count value stored in step S110. The difference of these count values, C2−C1, represents the amount of rotation of the first rotary shaft 21 from when the tip end of the first sheet 50*b* is detected by the first upstream sensor 22 to when the tip end of the first sheet 50*b* is detected by the first downstream sensor 23.

Cr is the amount of rotation of one rotation amount of the first rotary shaft 21, that is, the count number of the pulse signal output by the first encoder 24 during one rotation of the first rotary shaft 21, which is also a known value.

The equation (1) is a calculation based on the idea that the ratio of the distance L to the circumference D×n of the first roll body 50*a* and the ratio of C2−C1 to Cr are equal. The length of the first sheet 50*b* that is fed in one rotation of the first rotary shaft 21 is shorter as the outer diameter D decreases, so that the difference C2−C1 required to transport the first sheet 50*b* by the distance L increases as the outer diameter D decreases.

According to the steps S110, S120, and S140, the outer diameter calculating unit 12*b* calculates the outer diameter of the roll body based on the detection by the first sensor and the detection by the second sensor. Furthermore, at the time of step S140, it is clear that the tip end of the first sheet 50*b* has not reached the first roller pair 60, so that it can be said that the outer diameter calculating unit 12*b* calculates the outer diameter of the roll body before the tip end of the printing medium is pinched by the roller pair.

In step S150, the transport control unit 12*a* selects the rotational speed based on the outer diameter D of the first roll body 50*a* calculated in step S140 to rotate the first rotary shaft 21 at the selected rotational speed by controlling the first roll motor 20, and then resumes transporting the first sheet 50*b*. This allows the first sheet 50*b* to be transported downstream of the first downstream sensor 23.

FIG. 4 illustrates an example of a rotational speed table 71 that defines the correspondence relationship between the outer diameter of the roll body and the rotational speed of the rotary shaft holding the roll body. The rotational speed table 71 may be considered as a function defining a rotational speed in accordance with the outer diameter. In the present embodiment, the roller pairs 60, 61, 62 transport the sheet by rotating at a common constant speed by the transport motor 80, etc. Needless to exemplify, the constant speed does not mean only a precise and constant speed, but includes some speed error that occurs in the behavior of a motor or roller of an actual product. Here, when a transport distance of the sheet per second by the roller pairs 60, 61, 62 rotating at a constant speed is referred to as the reference transport speed, the first rotary shaft 21 also needs to feed the first sheet 50*b* at the reference transport speed. The rotational speed table 71 defines the rotational speed of the first rotary shaft 21 required to achieve the first sheet 50*b* to be fed out at the reference transport speed in accordance with the outer diameter. The rotational speed table 71 defines a higher rotational speed as the outer diameter decreases.

The correspondence relationship between the outer diameter and the rotational speed defined by the rotational speed table 71 may vary non-linearly or stepwise rather than varying linearly as illustrated in FIG. 4. In step S150, the transport control unit 12*a* may select, from the rotational speed table 71, a rotational speed corresponding to the outer diameter D of the first roll body 50*a* calculated in step S140.

The transport control unit 12*a* continuously controls the rotational speed of the first rotary shaft 21 in accordance with the rotational speed table 71 even after the first rotary shaft 21 is rotated in step S150 to resume the transportation of the first sheet 50*b*. This is because the outer diameter of the first roll body 50*a* gradually decreases. The outer diameter of the first roll body 50*a* after resuming the transport can be estimated in accordance with the amount of rotation of the first rotary shaft 21 after resuming the transport. Each time the first rotary shaft 21 is rotated, the outer diameter of the first roll body 50*a* decreases by approximately twice the thickness of the first sheet 50*b*. Accordingly, when the transportation of the first sheet 50*b* is resumed in step S150, the outer diameter calculating unit 12*b* may estimate the current outer diameter based on the amount of decrease in the outer diameter of the first roll body 50*a* corresponding to the rotation number of the first rotary shaft 21, and the outer diameter D calculated in step S140.

After resuming the transportation of the first sheet 50*b* in step S150, the transport control unit 12*a* may gradually increase the rotational speed of the first rotary shaft 21 in accordance with the outer diameter repeatedly estimated by the outer diameter calculating unit 12*b* and the rotational speed table 71. In addition, after resuming the transportation of the first sheet 50*b* in step S150, the transport control unit 12*a* may control the transport motor 80, etc. to start the rotation of the roller pairs 60, 61, 62 at a predetermined timing before the tip end of the first sheet 50*b* reaches the first roller pair 60.

After the transportation of the first sheet 50*b* is resumed in step S150, in the case where the tip end of the first sheet 50*b* is detected by the PE sensor 70 during the repeated estimation of the outer diameter as described above, the outer diameter calculating unit 12*b* re-calculates the outer diameter of the first roll body 50*a* triggered by the detection thereof (step S160). The outer diameter calculating unit 12*b* may calculate, from the time where the tip end of the first sheet 50*b* is detected by the PE sensor 70 to the time where the first roller pair 60 transports the first sheet 50*b* a predetermined distance, the outer diameter D again based on the relationship among the count value by the first encoder 24, the amount of rotation Cr described above, the predetermined distance, and the circumference D×n of the first roll body 50*a*. The predetermined distance referred to here is the distance downstream of the PE sensor 70 to a predetermined position. Also, the predetermined position is a position of the sensor (not illustrated) similar to the PE sensor 70 arranged downstream of the PE sensor 70, for example. After the tip end of the first sheet 50*b* is detected by the PE sensor 70, the count number of the pulse signal output by the first encoder 24 is counted until the tip end of the first sheet 50*b* is detected by the sensor. However, when the sensor is located downstream of the second roller pair 61, the transport control unit 12*a* stops driving the second driving roller 61*a* by the transport motor 80, and further leaves the second driving roller 61*a* idling, that is, the second roller pair 61 substantially does not pinch the first sheet 50*b*. Further, when the sensor is located downstream of the third roller pair 62, the transport control unit 12*a* stops driving the third driving roller 62*a* by the transport motor 80 in addition to the second driving roller 61*a*. Alternatively, the predetermined distance is any predetermined distance, where the count number of the pulse signal output by the first encoder 24 is counted while the first sheet 50*b* is transported a predetermined distance based on a pulse signal output by an encoder (not illustrated) that measures the amount of rotation of the first driving roller 60*a*. In this case, the predetermined distance may be set to a distance that is less than the distance between the PE sensor 70 and the second roller pair 61. When setting a distance to be greater than or equal to the distance between the PE sensor 70 and the second roller pair 61, the drive of the second drive roller 61*a* by the transport motor 80 is stopped. When setting a distance to be greater than or equal to the distance between the PE sensor 70 and the third roller pair 62, the drive of the second drive roller 61*a* and the third drive roller 62*a* by the transport motor 80 is stopped.

In step S170, the transport control unit 12*a* selects the rotational speed based on the outer diameter of the first roll body 50*a* re-calculated in step S160 to rotate the first rotary shaft 21 at the selected rotational speed by controlling the first roll motor 20. The method of selecting the rotational speed based on the outer diameter is the same as step S150. According to step S170, the rotational speed of the first rotary shaft 21 is changed depending on the result of re-calculating the outer diameter in step S160. Further, after re-calculating the outer diameter in step S160, the outer diameter calculating unit 12*b* can estimate the current outer diameter based on the outer diameter re-calculated in step S160.

According to FIG. 3, the transport control process performs and ends step S170, but the process that starts triggered by the above-described instruction to start printing will naturally continue thereafter. In other words, at a predetermined timing after the tip end of the first sheet 50*b* has passed through the second roller pair 61, the control unit 11 temporarily stops the transportation of the first sheet 50*b* and then performs printing on the first sheet 50*b* by performing alternation between the above-described pass and paper feeding.

The re-calculation of the outer diameter according to step S160 is performed in order to improve the accuracy of calculating the outer diameter. The calculation of the outer diameter according to step S140 is performed in a situation in which the tip end of the first sheet 50*b* is not pinched by the first roller pair 60, so that the first sheet 50*b* may be curved or tortuous in the transport path, and the calculation accuracy of the outer diameter may be slightly lower. Therefore, by calculating the outer diameter of the first roll body 50*a* again in a situation of step S160 in which the first sheet 50*b* is pinched between the first roller pair 60 and the position thereof is stable, the subsequent transportation of the first sheet 50*b* can be performed more accurately. However, the most significant characteristics of the present embodiment is that the outer diameter calculating unit 12*b* calculates the outer diameter of the roll body before the tip end of the printing medium is pinched by the roller pair, so that the control unit 11 may not perform the steps S160 and S170 in the transport control process.

Figure 5:
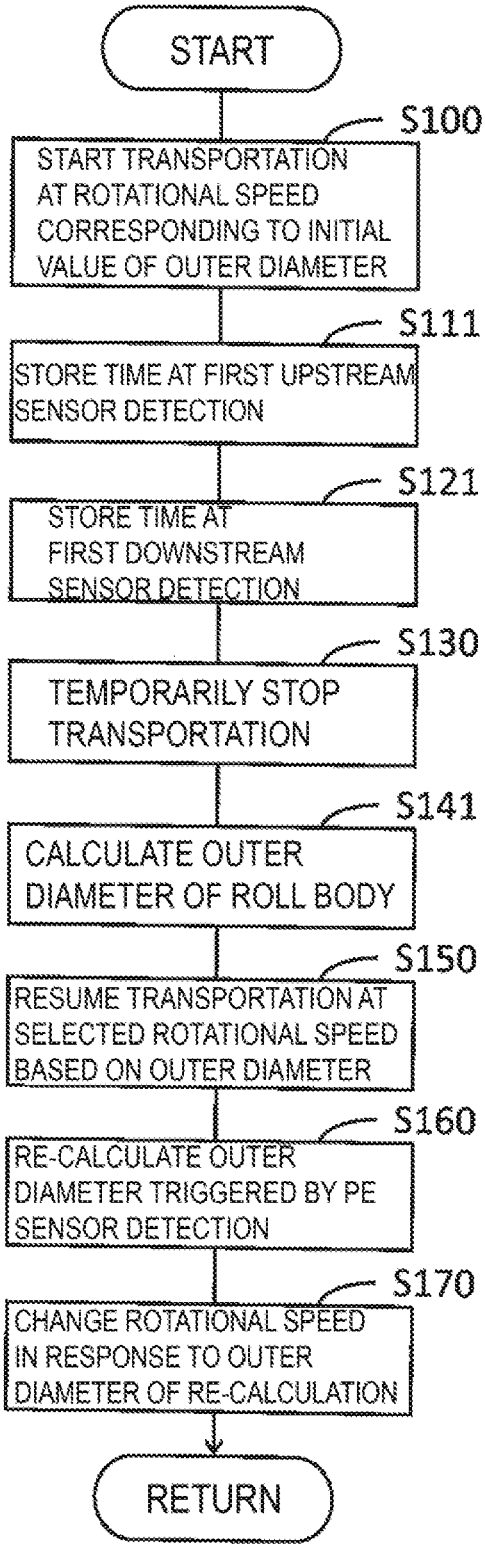
FIG. 5 is a flowchart illustrating an example of the transport control process of the printing medium different from that of FIG. 3.

FIG. 5 illustrates, a flowchart, the transport control process performed by the control unit 11 in accordance with the printing program 12, which is an example different from that illustrated in FIG. 3. In FIG. 5, steps S111, S121, S141 are performed instead of steps S110, S120, S140 of FIG. 3. Description of FIG. 5 in common with the description of FIG. 3 is omitted.

After the first sheet 50*b* is started to be transported by step S100, the outer diameter calculating unit 12*b* stores the time when the tip end of the first sheet 50*b* is detected by the first upstream sensor 22 (step S111). Furthermore, the outer diameter calculating unit 12*b* stores the time when the tip end of the first sheet 50*b* is detected by the first downstream sensor 23 (step S121).

In step S141, the outer diameter calculating unit 12*b* calculates the outer diameter D of the first roll body 50*a* according to the following equation (2).

$$D=(L/T)/(n\times RPS) \quad (2)$$

T is the difference between the time stored in step S121 and the time stored in step S111, which represents the elapsed time from when the tip end of the first sheet 50*b* is detected by the first upstream sensor 22 to when the tip end of the first sheet 50*b* is detected by the first downstream sensor 23.

The RPS is the rotation number per second of the first rotary shaft 21 from when the tip end of the first sheet 50*b* is detected by the first upstream sensor 22 to when the tip end of the first sheet 50*b* is detected by the first downstream sensor 23. Note that, since RPS=((C2−C1)/Cr)/T, the equation 1 and equation 2 are substantially the same.

In other words, according to FIG. 5, the outer diameter D of the first roll body 50*a* can be calculated using the elapsed time T from when the tip end of the first sheet 50*b* is detected by the first upstream sensor 22 to when the tip end of the first sheet 50*b* is detected by the first downstream sensor 23. According to the steps S111, S121, and S141, the outer diameter calculating unit 12*b* calculates the outer diameter of the roll body based on the detection by the first sensor and the detection by the second sensor. Furthermore, at the time of step S141, the tip end of the first sheet 50*b* has not reached the first roller pair 60, so that it can be said that the outer diameter calculating unit 12*b* calculates the outer diameter of the roll body before the tip end of the printing medium is pinched by the roller pair.

The description of FIG. 3 and FIG. 5 has been performed for a situation in which the first sheet 50*b* is transported from the first roll body 50*a* using the first transporting unit. Needless to exemplify, the description of FIG. 3 and FIG. 5 can be similarly performed for a situation in which the sheet is transported from the second roll body 51*a* using the second transporting unit.

3. Summary

As described above, according to the present embodiment, the printing apparatus 10 includes the rotary shaft rotating while holding the roll body obtained by winding the printing medium in a roll shape, the first motor rotating the rotary shaft, the roller pair transporting the printing medium downstream of the transport path by rotating in a state of pinching the printing medium fed from the roll body to the transport path by rotation of the rotating shaft, the second motor rotating the roller pair, the first sensor arranged at a position upstream of the roller pair in the transport path to detect the tip end of the printing medium or the feature formed at the printing medium, the second sensor arranged at a position upstream of the roller pair and downstream of the first sensor in the transport path to detect the tip end or feature of the printing medium, and the outer diameter calculating unit 12*b* configured to calculate the outer diameter of the roll body based on detection by the first sensor and detection by the second sensor. Then, the outer diameter calculating unit 12*b* calculates the outer diameter of the roll body before the tip end of the printing medium is pinched by the roller pair.

According to the foregoing configuration, the printing apparatus 10 can calculate the outer diameter of the roll body before the foregoing tip end is pinched by the roller pair, where the outer diameter of the roll body was previously unknown until the tip end of the printing medium fed from the roll body to the transport path is pinched by the roller pair for the transportation. As a result, this configuration allows for appropriately controlling the transportation of the printing medium in accordance with the outer diameter of the roll body during the time period until the foregoing tip end is pinched by the roller pair.

Referring to FIG. 2, the outer diameter of the first roll body 50*a* is determined substantially at the same time with the timing at which the tip end of the first sheet 50*b* fed from the first roll body 50*a* passes through the position of the first downstream sensor 23. As a result, the rotational speed of the first rotary shaft 21 can be controlled in accordance with the outer diameter of the first roll body 50*a* during the time period from when the tip end of the first sheet 50*b* passes through the first downstream sensor 23 to when the tip end reaches the first roller pair 60. By controlling the rotational speed of the first rotary shaft 21 in accordance with the outer diameter of the first roll body 50*a*, the transport speed of the first sheet 50*b* by the first rotary shaft 21 can be adjusted to the transport speed of the first roller pair 60. As a result, when the tip end of the first sheet 50*b* comes into contact with the first roller pair 60, this eliminates inconveniences of the sheet being sagged or pulled unnecessarily due to the incompatibility of these transport speeds, or unnecessary pulling of the sheet, which results in reduced transport accuracy.

According to the present embodiment, the outer diameter calculating unit 12*b* calculates the outer diameter of the roll body based on the amount of rotation of the rotary shaft from the time when the tip end or feature of the printing medium is detected by the first sensor to the time when the tip end or feature of the printing medium is detected by the second sensor, and the distance between the first sensor and the second sensor in the transport path. Alternatively, the outer diameter calculating unit may calculate the outer diameter of the roll body based on the time from when the tip end or feature of the printing medium is detected by the first sensor to when the tip end or feature of the printing medium is detected by the second sensor, the rotation number of the rotary shaft per unit time, and the distance between the first sensor and the second sensor in the transport path.

In addition, according to the present embodiment, the outer diameter calculating unit 12*b* may recalculate the outer diameter of the roll body after the tip end of the printing medium is pinched by the roller pair.

According to the foregoing configuration, by calculating the outer diameter of the roll body again in a state where the position of the transport printing medium is stable, the subsequent transportation can be performed more accurately.

For step S160, the outer diameter of the first roll body 50*a* has been described to be re-calculated in a situation in which the first sheet 50*b* is pinched by the first roller pair 60. However, after the tip end of the first sheet 50*b* is detected by the PE sensor 70, the outer diameter calculating unit 12*b* may re-calculate the outer diameter (step S160) from the time the first sheet 50*b* is further transported until the first sheet 50*b* passes through the second roller pair 61. In other words, the outer diameter of the first roll body 50*a* may be re-calculated in a situation in which the first sheet 50*b* is pinched by the second roller pair 61. However, when the outer diameter is re-calculated in such a manner, the transport control unit 12*a* stops driving the first driving roller 60*a* by the transport motor 80, and further leaves the first driving roller 60*a* idling, that is, the first roller pair 60 substantially does not pinch the first sheet 50*b*.

4. Modification

Various modifications included in the present embodiment will be described.

As illustrated in FIG. 2, the printing apparatus 10 includes the second rotary shaft 31 that rotates while holding the second roll body 51*a*, and the third motor (second roll motor 30) that rotates the second rotary shaft 31. The roller pairs 60, 61, 62 are arranged at positions downstream from the merging point 43 of the first transport path 41 from the first rotary shaft 21 and the second transport path 42 from the second rotary shaft 31. The first sensor (first upstream sensor 22) and the second sensor (first downstream sensor 23) are arranged at respective positions upstream of the merging point 43 in the first transport path 41.

Figure 6:
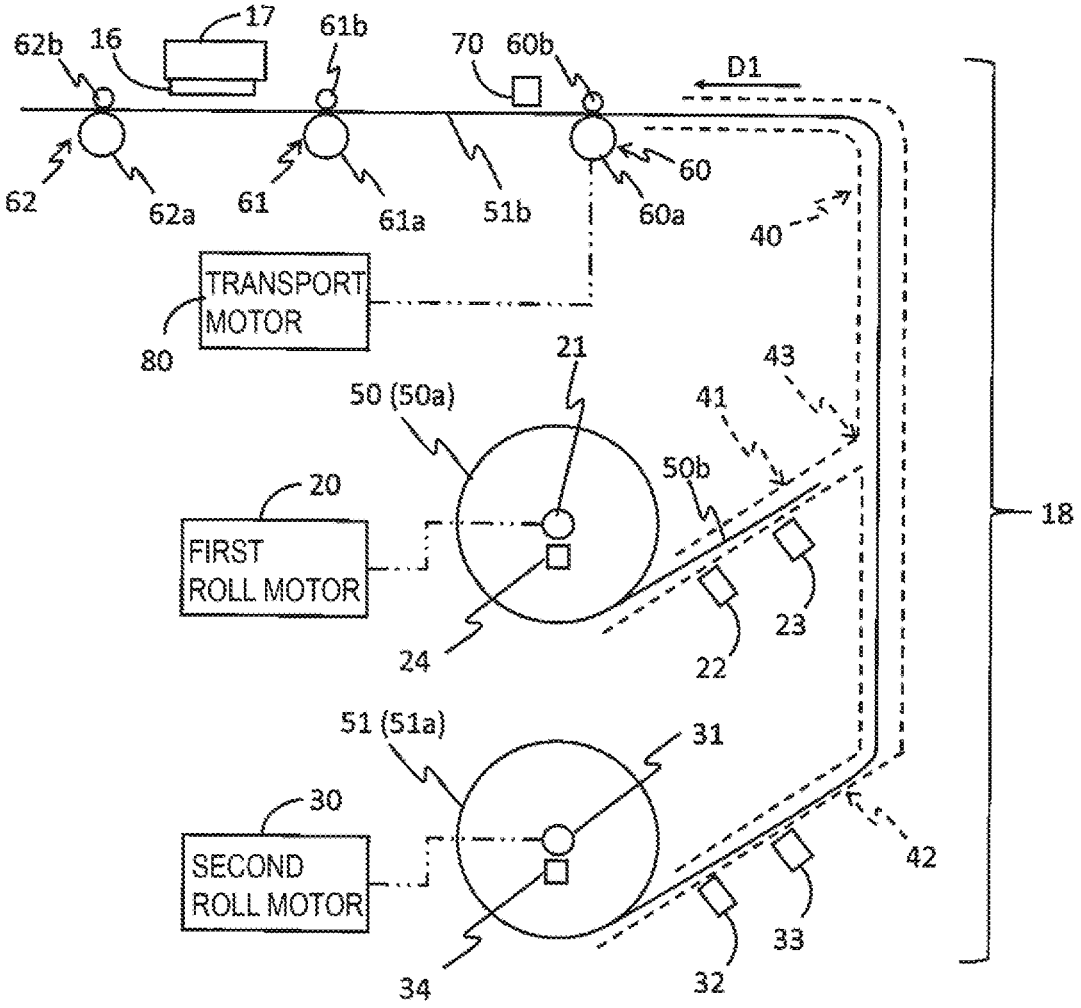
FIG. 6 is a diagram illustrating a state of a second sheet being transported in the structure including the transport unit and the printing head.

FIG. 6 simply illustrates a specific example of the structure including the transport unit 18 and the printing head 16, as in FIG. 2. FIG. 6 differs from FIG. 2 in that a second sheet 51*b* fed from the second roll body 51*a* held by the second rotary shaft 31 is transported by the roller pairs 60, 61, 62. In other words, in FIG. 6, the second sheet 51*b* is subjected to the transportation, where the printing is performed on the second sheet 51*b*.

Figure 7:
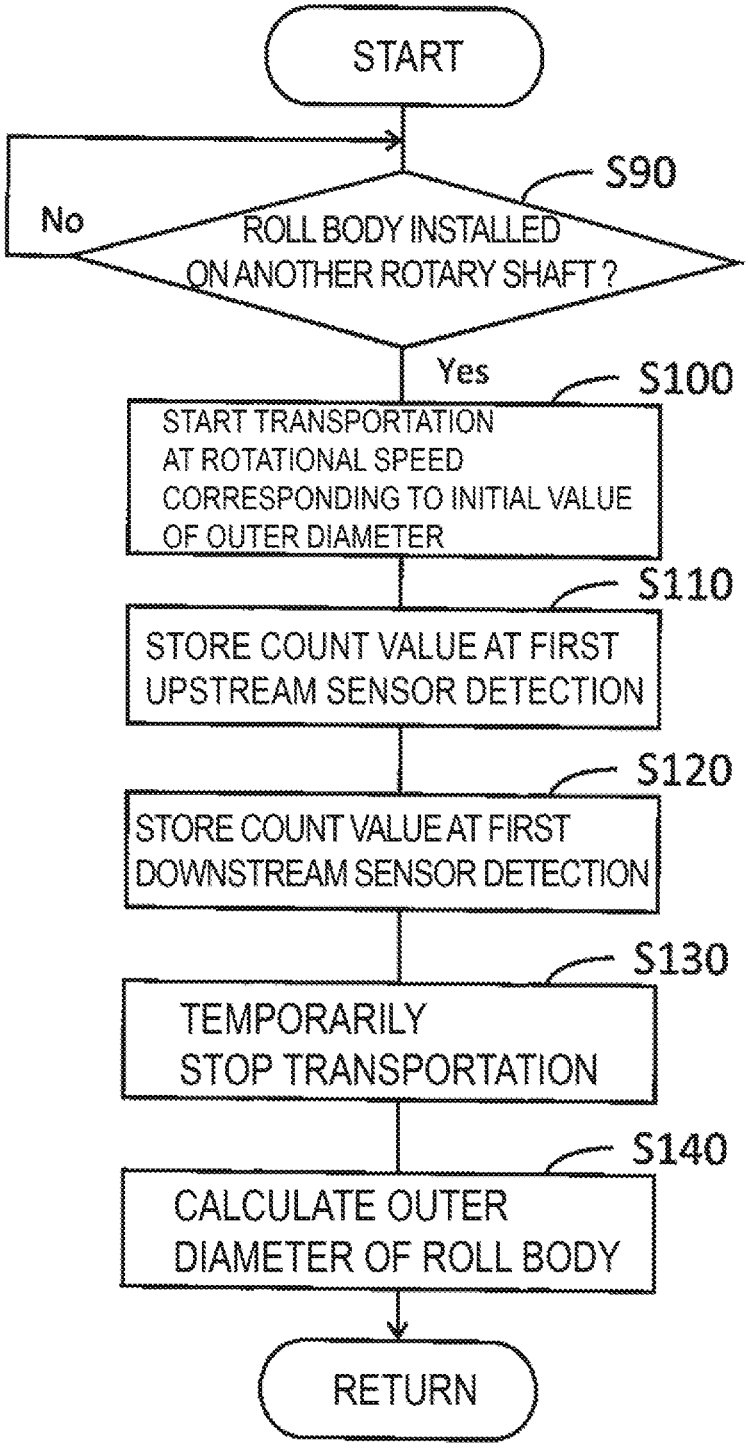
FIG. 7 is a flowchart illustrating an outer diameter calculation process for another roll body not being transported.

FIG. 7 illustrates, in a flowchart, an outer diameter calculation process for another roll body different from the roll body transporting the sheet. The control unit 11 starts the process in FIG. 7 triggered by the sheet fed from one roll body being pinched by the first roller pair 60. With respect to the description of FIG. 7, as illustrated in FIG. 6, it is assumed that the sheet 51*b* fed from the second roll body 51*a* to the second transport path 42 by rotation of the second rotary shaft 31 is pinched by at least the first roller pair 60. Therefore, with reference to the description of FIG. 7, "another roll body" refers to the first roll body 50*a*.

First, in step S90, the control unit 11 determines whether or not the roll body is installed on a rotary shaft that is different from the rotary shaft on which the printing medium is currently being transported. The determination of step S90 can be achieved by detecting the installation of the roll body with a sensor provided at the rotary shaft or in the vicinity of the rotary shaft, which is a type of the sensor 19. Following the example of FIG. 6, when the first roll body 50*a* is held in the first rotary shaft 21, the control unit 11 determines "Yes" in step S90. When the control unit 11 determines "Yes" in step S90, the control unit 11 proceeds to step S100 and subsequent steps.

Steps S100 to S140 illustrated in FIG. 7 are as described in FIG. 3. In other words, the outer diameter of the first roll body 50*a*, which is another roll body, is calculated. In step S130, around the time when the tip end of the first sheet 50*b* passes through the position of the first downstream sensor 23, the transportation of the first sheet 50*b* is temporarily stopped. In other words, according to FIG. 7, when the first roll body 50*a* is held by the first rotary shaft 21 in a state where the second sheet 51*b* is pinched by the first roller pair 60, etc., the first rotary shaft 21 feeds the first sheet 50*b* from the first roll body 50*a* to an extent that the tip end of the first sheet 50*b* does not reach the merging point 43. Then, the outer diameter calculating unit 12*b* calculates the outer diameter of the first roll body 50*a* during the process that the first sheet 50*b* is fed out from the first roll body 50*a* to an extent that the tip end of the first sheet 50*b* does not reach the merging point 43. In the example of FIG. 6, the tip end of the first sheet 50*b* has not reached the merging point 43.

According to FIG. 7 as described above, the outer diameter calculating unit 12*b* can calculate the outer diameter of the first roll body 50*a* in parallel, without inhibiting the transportation of the second sheet 51*b* currently subjected to the transportation and printing. By calculating the outer diameter of the first roll body 50*a* in such a manner, when processing of the second sheet 51*b* currently subjected to the transportation and printing is finished and the transport path 40 downstream of the merging point 43 is available, the control unit 11 can immediately start the process from step S150 for the first roll body 50*a*.

Instead of steps S110, S120, S140 in FIG. 7, steps S111, S121, and S141 illustrated in FIG. 5 may be performed. In addition, according to FIG. 7, in a situation in which the first sheet 50*b* of the first roll body 50*a* is currently subjected to the transportation or printing, the outer diameter of the second roll body 51*a*, which is "another roll body" at this time, can be calculated even when the second roll body 51*a* is installed on the second rotary shaft 31.

As another variation, the printing head 16 may be a so-called line head rather than a serial head mounted on the carriage 17. That is, the printing head 16 is an elongated head having a length capable of covering the width of the sheet in the primary scanning direction, and may have a structure that discharges ink onto the sheet transported in the transport direction D1 without moving the head in the primary scanning direction.

What is claimed is:

1. A printing apparatus comprising:

a rotary shaft configured to rotate while holding a roll body obtained by winding a printing medium in a roll shape;

a first motor configured to rotate the rotary shaft;

a roller pair configured to transport the printing medium downstream in a transport path by rotating in a state of pinching the printing medium fed from the roll body to the transport path by rotation of the rotary shaft;

a second motor configured to rotate the roller pair;

a first sensor arranged at a position upstream of the roller pair in the transport path to detect a tip end of the printing medium or a feature formed at the printing medium;

a second sensor arranged at a position upstream of the roller pair and downstream of the first sensor in the transport path to detect the tip end or feature of the printing medium; and an outer diameter calculating unit configured to calculate an outer diameter of the roll body based on detection by the first sensor and detection by the second sensor, wherein the outer diameter calculating unit calculates an outer diameter of the roll body before the tip end of the printing medium is pinched by the roller pair, and the outer diameter calculating unit calculates the outer diameter of the roll body based on an amount of rotation of the rotary shaft from a time when the tip end or feature of the printing medium is detected by the first sensor to a time when the tip end or feature of the printing medium is detected by the second sensor, and a distance between the first sensor and the second sensor in the transport path.

2. The printing apparatus according to claim 1, wherein the outer diameter calculating unit recalculates the outer diameter of the roll body after the tip end of the printing medium is pinched by the roller pair.

3. The printing apparatus according to claim 1, comprising a second rotary shaft configured to rotate while holding a second roll body obtained by winding a printing medium in a roll shape, and a third motor configured to rotate the second rotary shaft, wherein the roller pair is arranged at a position downstream of a merging point between a first transport path that is a transport path from a first rotary shaft that is the rotary shaft, and a second transport path that is a transport path from the second rotary shaft;

the first sensor and the second sensor are arranged at respective positions upstream of the merging point in the first transport path;

in a state where the roller pair pinches the printing medium fed from the second roll body to the second transport path by rotation of the second rotary shaft, when a first roll body that is the roll body is held by the first rotary shaft, the first rotary shaft feeds the printing medium from the first roll body to an extent that the tip end of the printing medium of the first roll body does not reach the merging point, and the outer diameter calculating unit calculates the outer diameter of the first roll body in a process in which the printing medium is fed from the first roll body to an extent that the tip end of the printing medium of the first roll body does not reach the merging point.

4. A printing apparatus comprising:

a rotary shaft configured to rotate while holding a roll body obtained by winding a printing medium in a roll shape;

a first motor configured to rotate the rotary shaft;

a roller pair configured to transport the printing medium downstream in a transport path by rotating in a state of pinching the printing medium fed from the roll body to the transport path by rotation of the rotary shaft;

a second motor configured to rotate the roller pair;

a first sensor arranged at a position upstream of the roller pair in the transport path to detect a tip end of the printing medium or a feature formed at the printing medium;

a second sensor arranged at a position upstream of the roller pair and downstream of the first sensor in the transport path to detect the tip end or feature of the printing medium; and an outer diameter calculating unit configured to calculate an outer diameter of the roll body based on detection by the first sensor and detection by the second sensor, wherein the outer diameter calculating unit calculates an outer diameter of the roll body before the tip end of the printing medium is pinched by the roller pair, and the outer diameter calculating unit calculates the outer diameter of the roll body based on a time period from a time when the tip end or feature of the printing medium is detected by the first sensor to a time when the tip end or feature of the printing medium is detected by the second sensor, a rotation number of the rotary shaft per unit time, and a distance between the first sensor and the second sensor in the transport path.

* * * * *